United States Patent [19]

Tang et al.

[11] Patent Number: 4,588,994

[45] Date of Patent: May 13, 1986

[54] CONTINUOUS FERRITE APERTURE FOR ELECTRONIC SCANNING ANTENNAS

[75] Inventors: Raymond Tang, Fullerton; Joseph M. Hellums, Torrance, both of Calif.

[73] Assignee: Hughes Aircraft Company, Los Angeles, Calif.

[21] Appl. No.: 440,391

[22] Filed: Oct. 18, 1982

[51] Int. Cl.[4] ..... H01Q 11/06

[52] U.S. Cl. ..... 343/754; 343/787; 343/371; 343/372

[58] Field of Search ..... 343/371, 372, 376, 754, 343/787

[56] References Cited

U.S. PATENT DOCUMENTS

| | | | |
|---|---|---|---|
| 2,973,516 | 2/1961 | Medved | 343/787 |
| 3,500,303 | 3/1970 | Johnson | 343/371 X |
| 3,525,995 | 8/1970 | Schroeder | 343/371 X |
| 3,534,374 | 10/1970 | Johnson | 343/787 |
| 3,588,901 | 6/1971 | Buck | 343/376 X |
| 3,750,180 | 7/1973 | Fujimoto et al. | 343/371 X |
| 3,765,021 | 10/1973 | Chiron et al. | 343/371 X |
| 3,811,128 | 5/1974 | Munson | 343/371 X |
| 4,092,647 | 5/1978 | Borowick et al. | 343/371 X |
| 4,150,382 | 4/1979 | King | 343/376 X |

OTHER PUBLICATIONS

IEEE Trans. on Ant. & Prop., vol. AP-16, No. 2, Mar. 1968, T. R. Schiller et al, "An Electronically Scanned Array at Millimeter Wavelength Employing Ferrite Apertures", pp. 180–187.

IEEE Trans. on Ant. & Prop., vol. AP-23, No. 1, Jan. 1975, E. Stern et al, "Ferroscan: Toward Continuous Aperture Scanning", pp. 15–20.

*Primary Examiner*—Theodore M. Blum
*Assistant Examiner*—John B. Sotomayor
*Attorney, Agent, or Firm*—Charles D. Brown; A. W. Karambelas

[57] ABSTRACT

A radiating element having a continuous aperture substantially greater than one-half the center frequency wavelength for use in an electronically scanned phased array antenna operating in the range of 94 GHz. The new radiating element comprises a ferrite block having a radiating aperture which measures 5λ by 5λ in contrast to the conventional discrete radiating element which measures one-half λ by one-half λ. Thus, where a phased array antenna comprised of an array of the new radiating elements would require only a single radiating element to fill an aperture measuring 5λ by 5λ, a phased array antenna of conventional design would require one hundred discrete radiating elements to fill the same aperture. A tapered magnetization is applied to the continuous aperture ferrite block. Thus electromagnetic energy traveling through the block and exiting the radiating surface is phase shifted, with respect to the energy entering the block, in a similar tapered fashion. The degree of phase shift can be varied by adjusting the slope of the tapered magnetization. This permits scanning of the continuous aperture pattern. The continuous aperture subarray is specially constructed to minimize the spacing between such elements which have been assembled to form an antenna array. The ferrite block has been split into two halves, separated by a dielectric, to minimize transverse magnetization and thereby improve the characteristics of the tapered magnetization applied to the ferrite block. When a plurality of such continuous aperture subarrays is used to form an antenna array, provision is made to adjust the phase at the center of each continuous aperture subarray with respect to the phase of the adjacent subarrays, thereby allowing scanning of the entire pattern of the phased array antenna.

10 Claims, 8 Drawing Figures

Fig. 7.
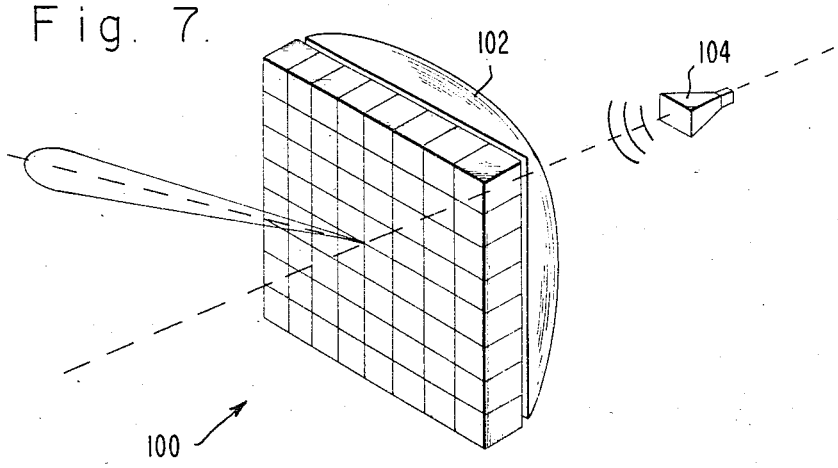
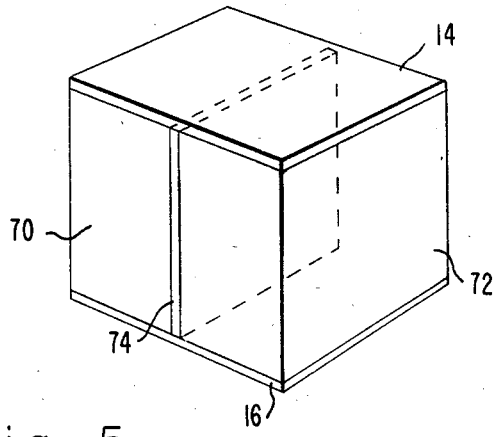
Fig. 5.

CONTINUOUS FERRITE APERTURE FOR ELECTRONIC SCANNING ANTENNAS

The government has rights to this invention pursuant to Contract No. DASG60-79-C-0084 awarded by the Department of the Army.

BACKGROUND OF THE INVENTION

1. Field of the Invention

The invention relates to the field of electronically scanned radar antennas and in particular to a continuous ferrite aperture subarray for an electronically scanned antenna intended to operate at about 94 GHz or higher.

2. Description of the Prior Art

Various means for effecting electronic scanning of an antenna aperture are known. Such scanning of phased arrays has been described in the literature including the phased array described in Radant: New Method of Electronic Scanning, by D. Herrick, C. Chekroun, Y. Michel, R. Pauchard and P. Vidal appearing in Microwave Journal, Vol. 24, No. 2, February 1981 at page 45. A copy of that article accompanies this application for patent.

Several patents discuss the steering of a beam of electromagnetic energy by passing the energy through a ferrite block in which a controllable non-uniform magnetization pattern has been established. The patent to R. E. Johnson, U.S. Pat. No. 3,369,242 is illustrative of the technique and provides a good background for the present invention. A copy of that patent accompanies this application for patent, and the teachings of that patent are incorporated in full herein by this reference for background purposes.

A second patent to Johnson, U.S. Pat. No. 3,534,374 combines resonant cavities with the teaching of the earlier Johnson patent to achieve what is claimed to be a highly efficient scanning antenna. The electromagnetic energy is reflected back and forth across the resonant cavity, each reflection increasing the amount of phase shift (and hence increasing the scan angle) of the output beam. A copy of that patent also accompanies this application for patent.

An antenna array system using diode phase shifters is shown in U.S. Pat. No. 3,305,867 issued Feb. 21, 1967 to A. R. Miccioli et al, and a copy of that patent accompanies this application for patent.

The conventional phased array antenna comprises a number of discrete radiating elements. The size of each element is dependent upon the intended operating frequency of the antenna array. Typically each discrete element has a height and width equal to one-half wavelength ($\lambda/2$). Thus, for an antenna operating at 94 GHz and constucted according to conventional design procedure, each radiating element in the array would measure 1.6 mm$\times$1.6 mm. The fabrication tolerances and the complexity of the corporate feed for such an array structure make the discrete element phased array approach not practical for antennas operating at frequencies in the 94 GHz range and higher.

SUMMARY OF THE INVENTION

The invention comprises a radiating element for use in an electronically scanned phased array antenna operating in the range of 94 GHz. The new radiating element comprises a ferrite block with a radiating aperture which measures $5\lambda$ by $5\lambda$ in contrast to the conventional discrete radiating element which measures only one-half $\lambda$ by one-half $\lambda$. Thus, where a phased array antenna comprised of an array of the new radiating elements would require only a single radiating element to fill a space measuring $5\lambda$ by $5\lambda$, a phased array antenna of conventional design would require one hundred discrete radiating elements to fill the same space. The size problems and the complexity of the corporate feed structure of the conventional design approach are thus greatly reduced if not eliminated. Because the new radiating element "replaces" one hundred of the discrete radiating elements of the prior art, it is referred to as a continuous aperture subarray. The continuous aperture subarray element is capable of scanning as taught herein, whereas the conventional discrete element does not scan.

A linearly tapered magnetic field is applied to the continuous aperture ferrite block. Thus, electromagnetic energy traveling through the block and exiting the radiating surface is phase shifted, with respect to the energy entering the block, in a similar tapered fashion. The degree of phase shift can be varied by adjusting the slope of the tapered magnetic field. This permits scanning of the continuous aperture pattern. The continuous aperture subarray is specially constructed to minimize the spacing between such elements which have been assembled to form an antenna array. The ferrite block has been split into two halves, separated by a dielectric, to minimize transverse magnetization and thereby improve the characteristics of the tapered magnetization effected in the ferrite block. When a plurality of such continuous aperture subarrays is used to form an antenna array, provision is made to adjust the phase at the center of each continuous aperture subarray with respect to the phase of the adjacent subarrays, thereby effecting a continuous phase taper across the entire antenna aperture and allowing proper scanning of the pattern of the entire phased array antenna.

DESCRIPTION OF THE FIGURES

FIG. 5 illustrates the use of a split ferrite block and a dielectric layer to minimize transverse magnetization.

FIG. 7 shows an alternate method of feeding an array of continuous ferrite aperture devices.

DETAILED DESCRIPTION OF THE INVENTION

Electronically steered phased array antennas have been known and used for a number of years. An overview of the historical development of phased arrays appears in "Phased Array Technology Workshop", an article appearing in Microwave Journal, Vol. 24, No. 2, February 1981, page 16 et seq., a copy of which accompanies this application for patent.

Various techniques are known for effecting electronic steering. One such technique is the use of a ferrite block having a controllable impressed magnetic field. The continuous ferrite aperture scanning approach as described herein is based on the theory of interaction between a circularly polarized plane wave and a remanent d.c. bias magnetization which is oriented parallel to the direction of propagation. Phase shift per unit distance varies almost linearly with the magnetization. Typically each discrete tranmsit/receive element in an array constructed according to the prior art has its own phase control device to effect steering. Each such discrete element constructed according to the prior art, and which may incorporate ferrite, must measure not more than one half wavelength ($\lambda/2$) on a side where $\lambda$ is the wavelength at which the antenna operates. For example, for antennas operating at 35 GHz each element in the array would measure approximately 4.28 mm square. In an electronically scanned array constructed according to the prior art, a specific amount of phase shift was introduced to each discrete transmit/-receive element. The amount of phase shift was uniform across the area of the discrete element. By increasing the phase shift of each element linearly across the array, the antenna was electronically steered. To achieve the uniform phase shift across each discrete element, a uniform magnetization was established within the ferrite block.

For an antenna operating at 94 Gz, the wavelength $\lambda$ is about 3.2 mm. Conventional phased array design practice would thus call for an array of discrete radiating elements each measuring 1.6 mm square. The fabrication of devices of such small dimensions poses difficult problems. Tolerances become extremely small. Packaging of the very complicated corporated feed structure feeding these elements also becomes difficult. Because of these size related problems, the discrete element phased array approach of the prior art is not practical for frequencies of 94 GHz and higher. To overcome these problems, applicants have developed a continuous aperture ferrite subarray with the capability of scanning the pattern of the continuous aperture.

Figure 1:
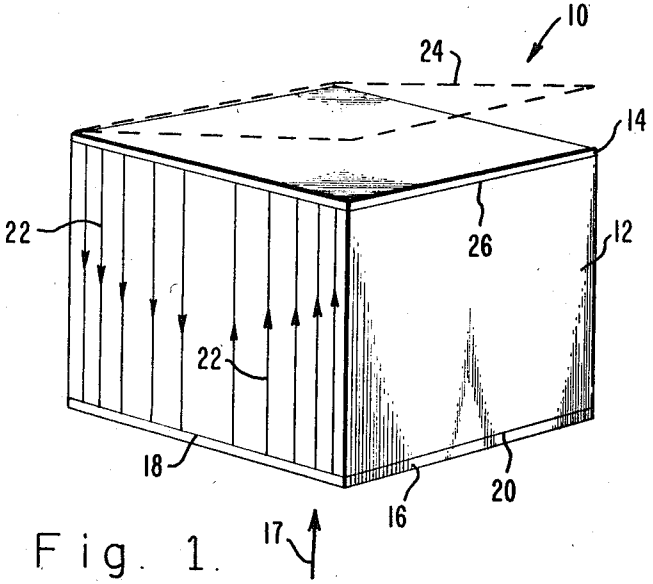
FIG. 1 is a perspective view of a block of ferrite material with lines of linearly tapered magnetization illustrated.

The continuous aperture ferrite block device 10 is illustrated in FIG. 1. It comprises a ferrite block 12 and front and back dielectric matching layers 14 and 16. The sides 18 and 20 of the ferrite block measure five wavelengths ($5\lambda$) compared to the one-half wavelength of conventionally designed radiating elements. Thus, for operation at 94 GHz, the sides 18 and 20 would each measure about 16 mm. Because the single device 10 is $5\lambda$ on a side and replaces what would otherwise be one hundred devices measuring one-half $\lambda$ on a side, the device 10 is referred to as a continuous aperture subarray. This subarray can be the basic building block for the construction of a large antenna array as explained below.

The ferrite block 12 may be composed of one of a variety of ferrite materials readily available. Two primary considerations will determine the particular ferrite material chosen. First, the ferrite material should be a low loss material. Second, the material should have a high magnetic saturation moment. A material that meets these requirements, and the one used by applicants in the evaluation of the continuous aperture described herein, is the material sold under the name Ampex 3-5000B. The number 5000 is an indication of the saturation moment, i.e. Ampex 3-5000B exhibits a saturation moment of 5000 gauss.

As oriented in FIG. 1, the electromagnetic energy (indicated by arrow 17) would illuminate the bottom layer 16 of dielectric material. If a uniform magnetization is effected within the block 12, the electromagnetic energy exiting the dielectric layer 14 would be uniformly phase shifted across the entire aperture. By impressing a linearly tapered magnetization as indicated by the lines 22, the phase shift is also linearly tapered across the aperture as indicated by plane 24 in FIG. 1. The distance of plane 24 above the top 26 of block 12 is meant to represent the relative amount of phase shift. As shown, the amount of phase shift is a relative minimum at the left hand side of FIG. 1 and is a relative maximum at the right hand side. The degree of scanning may be varied by controlling the slope of the magnetization taper. The slope of the taper is adjusted by varying the magnitude of the current generating the magnetization, either manually or by electronic control circuitry represented by box 28 in FIG. 4.

Figure 2:
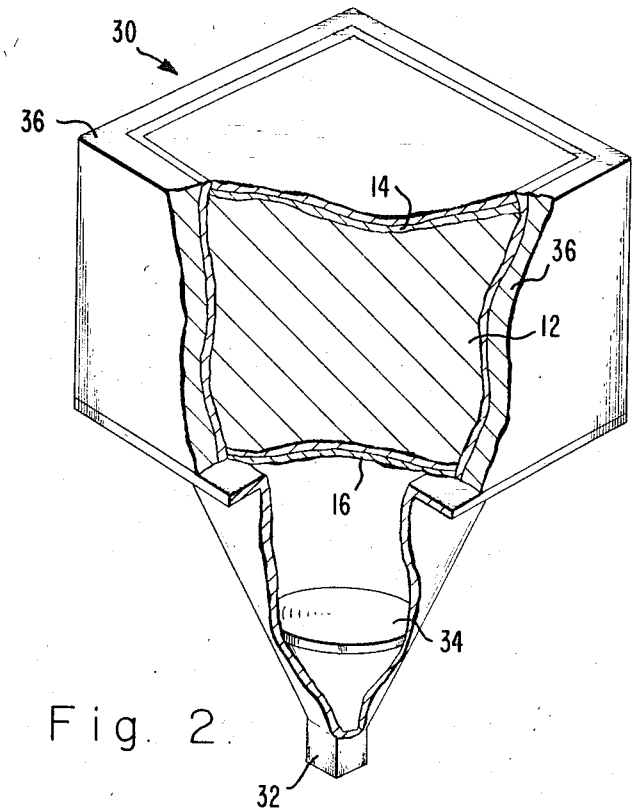
FIG. 2 is a cutaway perspective diagram of the continuous ferrite aperture device of the present invention.
Figure 3:
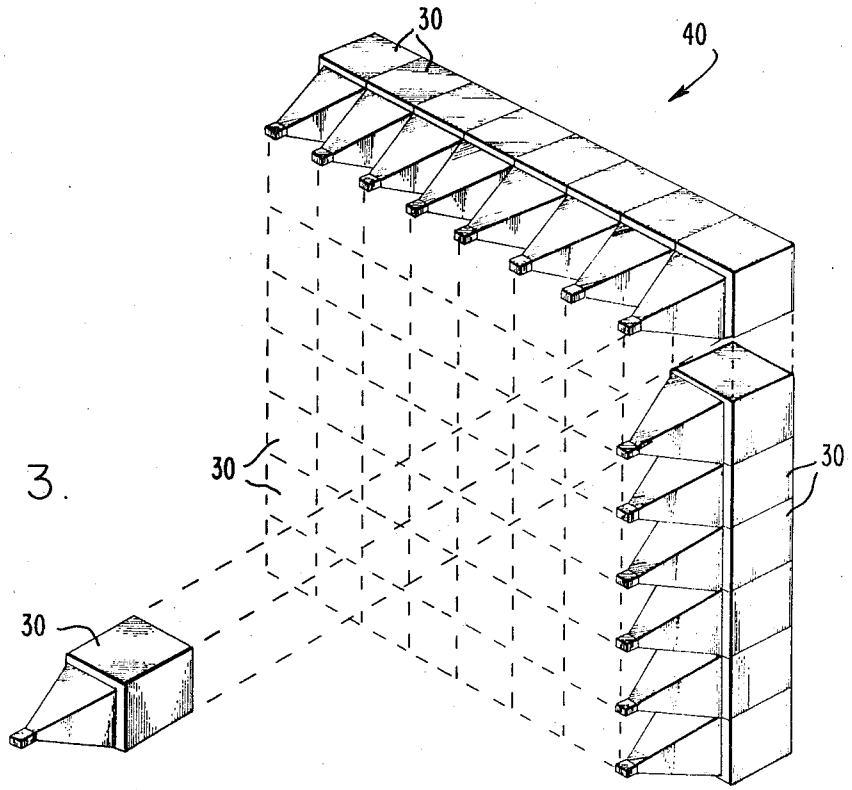
FIG. 3 is a rear view perspective of a scanning antenna array comprised of a plurality of the continuous ferrite aperture devices shown in FIG. 2.

The continuous aperture ferrite block device 10 may be contained within a structure such as shown in FIG. 2 to form a continuous ferrite aperture scanning antenna 30. If the scanning antenna 30 is part of a larger array such as shown in FIG. 3, it will receive electromagnetic energy from a corporate feed structure (not shown) feeding the horn 32 and collimating lens 34 of each antenna 30. The collimated electromagnetic energy impinges upon the dielectric matching layers 16 and enters ferrite block 12. The ferrite block 12 and matching layers 16 and 14 are housed within a magnetizing structure 36. A plurality of such continuous ferrite aperture scanning antennas 30 may be assembled to form a larger aperture two-dimensional scanning antenna array 40 as shown in FIG. 3.

Figure 4:
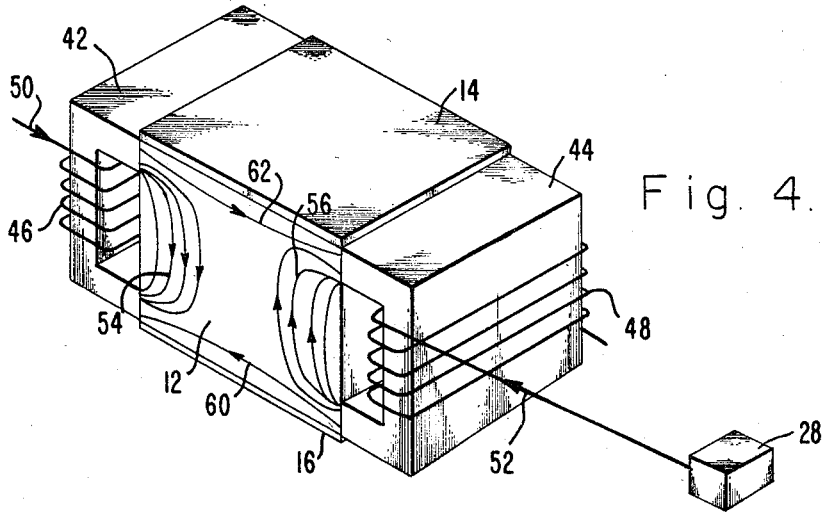
FIG. 4 is a perspective view of the ferrite block illustrating one method of setting up a tapered magnetic field.

The linearly tapered magnetization, necessary to scan the pattern of the continuous aperture ferrite block 12, may be effected within the ferrite block 12 by the yoke and coil structure shown in FIG. 4. Each ferrite yoke 42 and 44 supports a respective coil 46 and 48 for directing currents indicated by arrows 50 and 52. Current flow through coil 46 will produce vertical lines 54 of magnetization. Current flow through coil 48 will produce vertical lines 56 of magnetization having a polarity opposite that of lines 54.

The magnetization produced by the current flow through coil 46 combines with the magnetization produced by the current flow through coil 48 to form a resultant magnetization which is an approximation of the ideally desired linearly tapered magnetization. Further references herein to a magnetization having a linear taper should be understood to mean a magnetization which has a taper that, to the extent practicable, has been made to closely approximate a linear taper.

The combination of current flow through both coils will also produce undesired transverse magnetization indicated by transverse lines 60 and 62. The transverse magnetization can be minimized by splitting ferrite block 12 into two halves 70 and 72 and separating the two halves by a thin (non-magnetic) dielectric spacer 74 as shown in FIG. 5. The spacer 74 and two block halves 70 and 72 may then be used with the dielectric matching layers 14 and 16 and yoke and coil structure to achieve increased scanning capability. The spacer 74 may be on the order of 0.15 inch (0.381 mm) in thickness.

The substance used to form the dielectric spacer 74 is not of primary concern. The only requirements of the spacer are that it has a dielectric constant approximately equal to that of the ferrite block and that it is so thin that for all practical purposes electromagnetic loss in the spacer can be ignored. Materials which have been used to form the spacer include quartz and ceramic.

Figure 6:
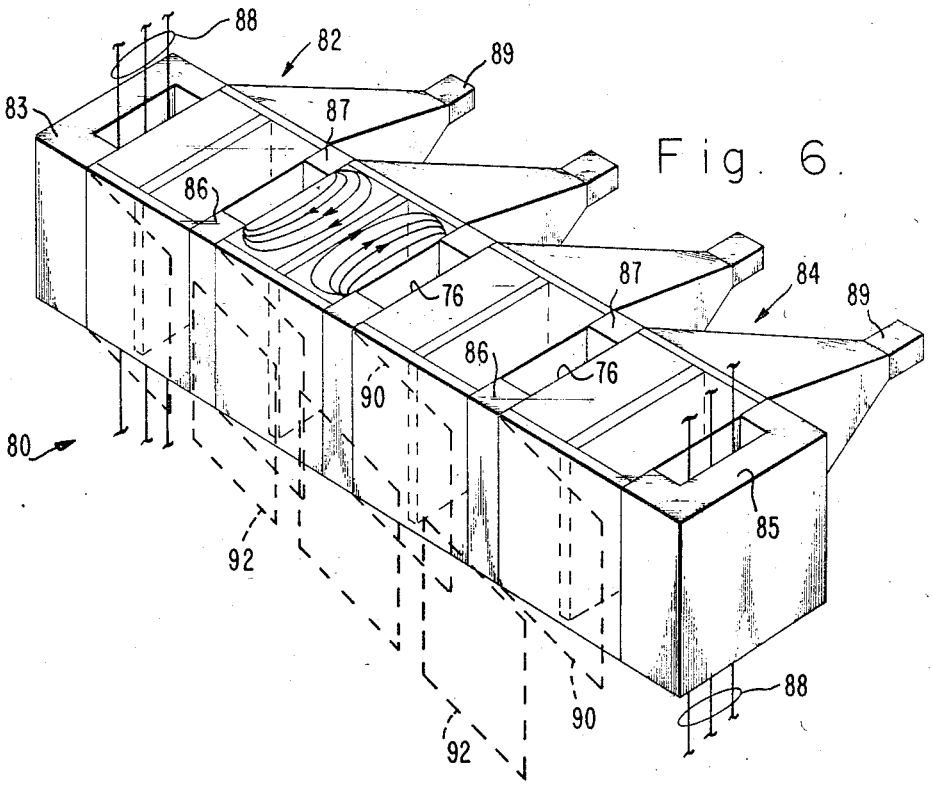
FIG. 6 illustrates a row of continuous aperture devices arrayed and structured to form a compact scanning row.

If a plurality of such continuous ferrite aperture subarrays as shown in FIG. 4 is arranged to form a larger antenna array, the presence of the yokes 42, 44 and coils will produce substantial gaps 76 (see FIG. 6) between the ferrite blocks 12, which will degrade performance. Ideally, the gap 76 between adjacent blocks should be zero for best antenna performance. By eliminating the yokes (as shown in FIG. 6) between adjacent ferrite blocks, the gaps can be substantially reduced, thereby improving antenna performance and resulting in a compact antenna array. An array of such continuous ferrite aperture subarrays might be similar to the row 80 shown in FIG. 6.

Row 80 comprises four continuous ferrite aperture subarrays. Only the two end subarrays 82 and 84 have yokes 83 and 85 respectively. The yokes that would otherwise appear between adjacent subarrays have been replaced by spacers 86 and 87. The tapered magnetization in each subarray is established by a current flowing through each of the various electrical conductor groups 88. One conductor group 88 is located in each gap 76. The magnetic field surrounding each conductor group is closed through the adjacent ferrite blocks. Hence, the adjacent ferrite blocks are essentially used as yokes for each other. The electrical conductor groups 80 run the full height of the array of subarrays and are closed in a very large loop so that the magnetic field approaches the ideal magnetic field that would be produced by a conductor of infinite length.

Each subarray has an associated feed horn 89 and collimating lens, and is provided with a means for effecting a phase shift of the incoming electromagnetic energy. If each continuous aperture subarray could only effect a tapered phase shift across the aperture of the subarray, the phase shift across a row of an array would comprise a series of identical tapered phase shifts represented by the broken lines 90 in FIG. 6. By providing a means for obtaining a phase difference between one subarray and the adjacent subarray, the phase can be made to taper continuously across the aperture of the entire array as indicated by broken lines 92 of FIG. 6. This phase difference between adjacent subarrays may be provided by a phase shifter device associated with each horn or the corporate feed structure feeding the horn. The phase shifter could be a conventional waveguide ferrite phase shifter as commonly used in the corporate feed structures of phased array antennas operating at lower frequencies, i.e. much lower than 94 GHz. Such an arrangement permits the pattern of the entire antenna array to be electronically scanned.

Figure 8:
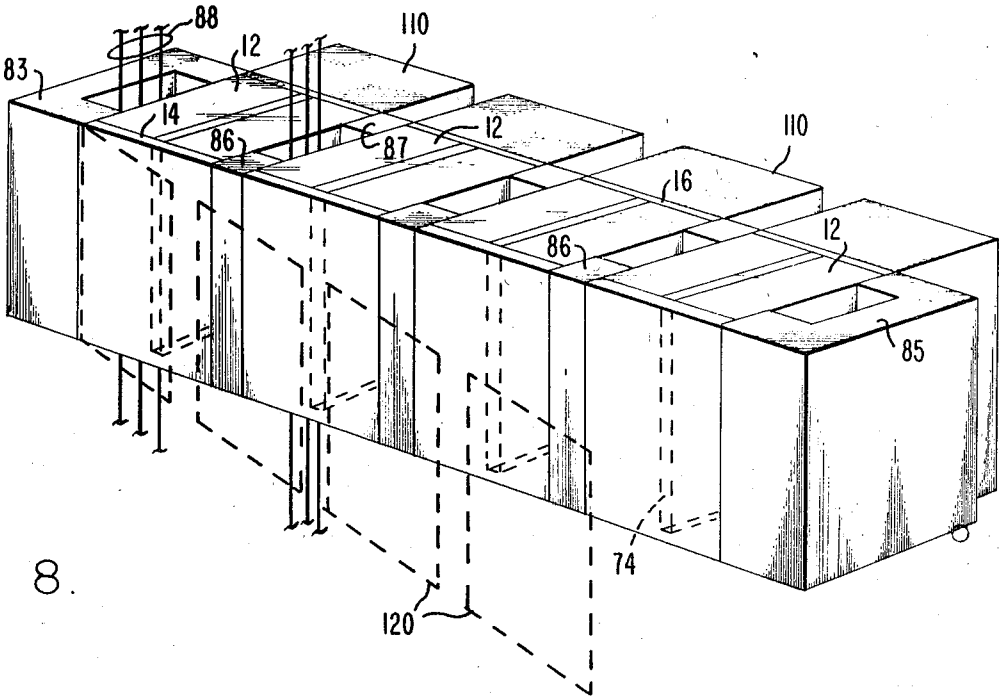
FIG. 8 shows the construction details of the continuous ferrite aperture devices used to form the array of FIG. 7.

The use of feed horns can be eliminated by using a space feed arrangement as illustrated for the antenna array 100 of FIG. 7. The array 100 comprises a plurality of continuous ferrite aperture subarrays, a collimating lens 102 coupled to the back of the array 100, and a space feed horn 104 for illuminating the collimating lens 102 with electromagnetic energy. When the space feed arrangement is used, the tapered phase of one continuous aperture subarray may be shifted with respect to the tapered phase of an adjacent continuous aperture subarray by adding a second ferrite block 110 to the back of each ferrite block 12, as shown in FIG. 8. A uniform magnetization is effected within each block 110. Thus the tapered phase of each block 12 is shifted with respect to the tapered phase of an adjacent block 12. As a result, the entire array pattern may be scanned as indicated by the lines 120 of coplanar phase shift shown in FIG. 8.

Ideally, the magnetization established within block 110 would be uniform across the block. However, a truly uniform magnetization is not easily achieved. Just as the previously mentioned tapered magnetization can be approximated by the sum of two opposing magnetizations, the uniform magnetization can be approximated by the sum of the two similarly polarized magnetizations. Referring to FIG. 4, the linear taper is achieved by combining a first magnetization produced by coil 46 and a second magnetization produced by coil 48. The currents flowing in each coil are directed to produce magnetizations which oppose one another. By reversing the direction of current in either coil, the two magnetizations will combine to produce a magnetization which approximates a uniform magnetization. Such a uniform magnetization could similarly be established in blocks 110 of FIG. 8.

In sizing the current used to produce the magnetization, it should be noted that the larger the volume of the ferrite block, the more power needed to change the magnetization quickly. The circuitry for controlling the switching of the currents is readily available and commonly used in waveguide ferrite phase shifters.

When the first split blocks, comprising two block halves 70 and 72, with a dielectric spacer 74 between them, were constructed and tested, it was found that the sidelobe levels were much higher than for the solid blocks. It was concluded that the contact between the dielectric 74 and ferrite blocks 70 and 72 was a major factor affecting sidelobe level. Thus, steps were taken to improve the degree of contact including the elimination of the use of glue between the parts and careful preparation and polishing of parts to insure flatness. The use of highly flat polished surfaces and the avoidance of glue improved the sidelobe levels, with a corresponding improvement in scanning performance.

While the invention has been described with reference to FIGS. 1–8, the description and figures are to be taken as illustrative of the invention rather than taken in a limiting sense. Various changes, additions and substitutions of material, and arrangement of parts can be made by one of ordinary skill in the art without departing from the spirit and scope of the invention as set forth in the appended claims.

We claim:

1. An electronically scanned continuous aperture antenna comprising:

a ferrite block having a front surface and a parallel back surface, each such surface having a height substantially equal to its width, said block comprising a first half block and a second half block separated by a layer of non-magnetic dielectric material oriented with its major surfaces parallel to the direction of propagation of electromagnetic energy so as to reduce transverse magnetization of said ferrite block;

means coupled to the back surface for illuminating said back surface with electromagnetic energy waves;

said front and back surfaces having dimensions substantially greater than one half the wavelength of said energy waves;

means for establishing a magnetization within said ferrite block, the strength of said magnetization having a substantially linear taper across the ferrite block in a plane orthogonal to the direction of propagation of said electromagnetic energy waves; and means for adjusting the slope of said taper;

whereby electromagnetic energy waves emerging from the front surface of said block are phase shifted with respect to the electromagnetic energy waves entering said back surface by an amount which varies in the same manner as said magnetization, and said continuous aperture may be scanned by adjusting the slope of said taper.

2. The antenna according to claim 1 wherein said means for establishing a magnetization comprises:

a pair of yokes, each yoke coupled to opposing sides of said block other than said front and back; and a pair of yoke coils each coupled to a respective one of said pair of yokes, for directing electrical current therethrough;

whereby the magnetization produced by said current passes through a portion of said block and is closed through said yoke.

3. The antenna according to claim 2 wherein the magnetization produced in said first half of said block is of the opposite polarity as the magnetization produced in said second half of said block.

4. A plurality of antennas according to claim 1 assembled in cooperative relationship to form an array, and further comprising:

means for applying a uniform phase shift of adjustable magnitude to the electromagnetic energy waves entering the back surface of each of the ferrite blocks of said array whereby the total phase shift applied to the electromagnetic energy waves tapers continuously across the entire array.

5. An array according to claim 4 wherein said means for illuminating comprises:

a radiating horn and a collimating lens for receiving electromagnetic energy waves from said horn and directing said waves to uniformly illuminate said back surface; and said means for applying a uniform phase shift comprises a phase shifter device coupled to each radiating horn of said array.

6. An array according to claim 5 wherein said array is a row array having a first end and a second end, each antenna of said row array being coupled in spaced apart relationship to at least one adjacent antenna by spacers; and a first yoke coupled to said first end and a second yoke coupled to said second end, whereby a compact row array is effected.

7. An array according to claim 5 wherein said array is a rectangular array, each antenna of said rectangular array being coupled in spaced apart relationship to at least two adjacent antennas by spacers; and a plurality of yokes, each yoke of said plurality of yokes being coupled to a surface of a respective antenna lying on the perimeter of said rectangular array.

8. The array according to claim 4 wherein said means for applying a uniform phase shift comprises:

a plurality of second ferrite blocks, each one of said plurality of second ferrite blocks being coupled to the back surface of a respective one of said plurality of antennas and subjected to a uniform magnetization of adjustable intensity; and wherein said means for illuminating comprises a single space feed horn for directing electromagnetic energy waves and a single collimating lens for receiving electromagnetic energy waves from said horn and guiding said electromagnetic energy waves so as to uniformly illuminate one surface of said plurality of second ferrite blocks.

9. An array according to claim 8 wherein said array is a row array having a first end and a second end, each antenna of said row array being coupled in spaced apart relationship to at least one adjacent antenna by spacers; and a first yoke coupled to said first end and a second yoke coupled to said second end, whereby a compact row array is effected.

10. An array according to claim 8 wherein said array is a rectangular array, each antenna of said rectangular array being coupled in spaced apart relationship to at least two adjacent antennas by spacers; and a plurality of yokes, each yoke of said plurality of yokes being coupled to a surface of a respective antenna lying on the perimeter of said rectangular array.

* * * * *